US010531736B1

(12) United States Patent
Kang

(10) Patent No.: US 10,531,736 B1
(45) Date of Patent: Jan. 14, 2020

(54) BOOKSHELF FOR EASY WITHDRAWAL OF BOOKS

(71) Applicant: Seungho Kang, Barrigada, GU (US)

(72) Inventor: Seungho Kang, Barrigada, GU (US)

( * ) Notice: Subject to any disclaimer, the term of this patent is extended or adjusted under 35 U.S.C. 154(b) by 0 days.

(21) Appl. No.: 16/279,049

(22) Filed: Feb. 19, 2019

(51) Int. Cl.
*A47B 63/00* (2006.01)
*A47B 88/944* (2017.01)

(52) U.S. Cl.
CPC ..... *A47B 63/00* (2013.01); *A47B 88/944* (2017.01)

(58) Field of Classification Search
CPC ..... A47B 63/00; A47B 88/944
USPC ..... 211/42, 43
See application file for complete search history.

(56) References Cited

U.S. PATENT DOCUMENTS 587,580 A * 8/1897 Hopkins et al. ..... A47B 65/00 211/42
758,868 A * 5/1904 Storm ..... A47B 65/00 211/43
2,527,277 A * 10/1950 Schade ..... A47B 65/00 211/42
2,750,052 A * 6/1956 Brown ..... A47B 46/00 108/143
3,317,176 A * 5/1967 Herrin ..... B42F 17/08 211/43
3,635,351 A * 1/1972 Homs ..... A47B 19/04 211/42
3,703,325 A * 11/1972 Schnarr ..... A47B 63/00 312/307
3,705,754 A * 12/1972 Drum ..... A47B 55/00 312/409
4,179,848 A * 12/1979 Gauron ..... B64D 11/00 49/124
5,038,689 A * 8/1991 Duffy ..... A47B 65/00 108/108
5,074,420 A * 12/1991 Cappel, III ..... A47B 65/00 211/181.1
5,131,732 A * 7/1992 Lane ..... A47B 63/00 312/190
5,385,399 A * 1/1995 Weidner ..... A47B 63/00 312/190
5,860,535 A * 1/1999 Brown ..... A47B 65/00 211/184
5,906,422 A * 5/1999 Golias, Sr. ..... A47B 88/402 312/334.12
6,321,918 B1 * 11/2001 Rollins ..... A47B 87/0207 211/194
6,913,156 B1 * 7/2005 Wolff ..... A47B 57/586 211/184

(Continued)

FOREIGN PATENT DOCUMENTS

GB 911356 A * 11/1962 ..... A47B 63/00
KR 200337581 1/2004

(Continued)

*Primary Examiner* — Stanton L Krycinski
(74) *Attorney, Agent, or Firm* — Fish & Richardson P.C.

(57) ABSTRACT

A bookshelf defines a book stand space that is configured to receive a book, and includes a tilt guide bar that is located at a bottom portion of the book stand space and that extends in a lateral direction. The tilt guide bar is configured to, based on the book being pressed downward, allow the book to be tilted about the tilt guide bar and to guide a withdrawal of the book in a state in which an upper end portion of the book protrudes forward.

6 Claims, 10 Drawing Sheets

(56) References Cited

U.S. PATENT DOCUMENTS

| | | | | |
|---|---|---|---|---|
| 8,960,823 | B2 * | 2/2015 | Golias | A47B 96/02<br>220/23.88 |
| 2002/0162815 | A1 * | 11/2002 | Wang | A47B 43/00<br>211/194 |
| 2014/0212201 | A1 * | 7/2014 | Ireland | A47B 63/00<br>402/70 |

FOREIGN PATENT DOCUMENTS

| | | | | |
|---|---|---|---|---|
| KR | 2020100001202 | | 2/2010 | |
| KR | 200472731 | | 6/2014 | |
| KR | 101500674 | | 3/2015 | |
| KR | 101507858 | | 4/2015 | |
| KR | 101603938 | | 3/2016 | |
| WO | WO-0051466 | A1 * | 9/2000 | A47B 46/00 |

* cited by examiner

BOOKSHELF FOR EASY WITHDRAWAL OF BOOKS

TECHNICAL FIELD

The present disclosure relates to a bookshelf and more particularly, to a bookshelf that is convenient to withdraw a book.

BACKGROUND

A bookshelf may be used to store books in multiple shelves. In some cases, the books on the bookshelf may be placed on fixed book stands which may cause an inconvenience for a user to withdraw the books from the fixed book stands.

A user may withdraw a book from a shelf among the multiple shelves in the bookshelf. In some cases, when a space between upper and lower book stands is narrow, it may be inconvenient to withdraw the book. For instance, when tilting a book in order to withdraw the book, the book may interfere with the upper book stand.

In some cases, a bookshelf may include a main body that includes book stands arranged in a multi-stage manner, brackets located at both ends of the book stands to prevent the books from falling down, and rails located at both inner surfaces of the bookshelf main body in correspondence with the book stands. In some cases, the brackets of the book stands may include a front wheel and a rear wheel that are movably fitted into the rail for guiding the book stands. In some cases, the book stands may be drawn out from the bookshelf main body like a drawer.

In some examples, when a user withdraw a book in a state in which books are tightly packed in the book stand, the user may need to slightly lift up a top end portion of the book by using a finger in order to withdraw the book, which may cause an inconvenience.

This application is related to a Korean patent application of the same inventor, Serial No. 10-2017-0088191, filed on Jul. 12, 2017.

SUMMARY

This application describes a bookshelf that is convenient to withdraw a book, in which a sliding shelf is installed on the bookshelf such that the sliding shelf can protrude forward and a semicircular guide bar is installed on a bottom of the sliding shelf such that a book is tilted forward when a user presses a top end portion of the book, thereby allowing the user to easily withdraw the book.

The objects are not limited to the object mentioned above, and other objects, which are not mentioned above, can be clearly understood by those skilled in the art from the following description.

According to one aspect of the subject matter described in this application, a bookshelf includes: a frame that defines at least one book stand space configured to receive a book, where the frame include a first frame wall and a second frame wall that faces the book stand space; a sliding shelf disposed in the book stand space configured to insert into and withdraw from the book stand space; a rail portion that is disposed at the first frame wall, the second frame wall, and the sliding shelf and that is configured to allow the sliding shelf to insert into and withdraw from the book stand space; and a tilt guide bar that is disposed at a bottom surface of the sliding shelf and that extends in a lateral direction toward the first frame wall and the second frame wall. The tilt guide bar is configured to, based on the book being pressed downward in a state in which the sliding shelf moves forward along the rail portion, allow the book to be tilted about the tilt guide bar and cause an upper end portion of the book to protrude forward. The tilt guide bar is further configured to guide a withdrawal of the book in a state in which the upper end portion of the book protrudes forward.

Implementations according to this aspect may include one or more of the following features. For example, the sliding shelf may include the bottom surface, a first side wall, a second side wall, and a rear wall, where the sliding shelf defines a front opening at a front surface of the sliding shelf and a top opening at a top surface of the sliding shelf. In some examples, the rail portion may include: a fixed rail coupled to the first frame wall and the second frame wall; and a sliding rail that is coupled to the first side wall and right side wall, and that is movably coupled to the fixed rail, and that configured to move relative to the fixed rail.

In some implementations, the tilt guide bar may have a semicircular sectional shape or a semi-elliptical sectional shape, and be attached to the sliding shelf. In some examples, the tilt guide bar may be disposed at a front side with respect to a longitudinal center of the sliding shelf. In some examples, the sliding shelf may define: a tilt guide bar receiving groove that has a semicircular sectional shape, that is recessed from the bottom surface of the sliding shelf, and that extends in the lateral direction; and a fixing hole that is disposed at a lower end of the first side wall and a lower end of the second side wall, the fixing hole being configured to receive ends of the tilt guide bar.

In some implementations, the tilt guide bar may have a circular sectional shape, where the tilt guide bar includes a lower portion inserted into the tilt guide bar receiving groove, and an upper portion that protrudes upward from the bottom surface of the sliding shelf. In these examples, the tilt guide bar may be rotatably coupled to the first side wall and second side wall of the sliding shelf. In some examples, the tilt guide bar may include a fixed bar fixed in the fixing hole, and a rotary tube that rotatably accommodates the fixed bar.

In some implementations, the tilt guide bar may include: a fixed bar disposed at both ends of the tilt guide bar, the fixed bar including a fitting protrusion coupled into the fixed hole; and a plurality of rotary rings that are each rotatably fitted to the fixed bar. In some examples, the fixed bar may define: a space portion at both side ends of the fixed bar, where the space portion is configured to receive a portion of the fitting protrusion; and a fitting protrusion withdraw hole that is in communication with the space portion and that is configured to allow the fitting protrusion to withdraw from and protrude toward the sliding shelf.

In some examples, the fixed bar further may include a spring disposed in the space portion, the fitting protrusion may include: a body portion disposed inside of the space portion; and a protrusion portion that extends from the body portion, that is configured to protrude outward through the fitting protrusion withdraw hole based on elasticity of the spring, and that is configured to move toward the fitting protrusion withdraw hole based on the protrusion portion being pressed in the lateral direction.

In some implementations, the tilt guide bar may be configured to contact and support a bottom surface of the book. In some implementations, the tilt guide bar may be configured to support the book in a first tilt position based on receiving the book, and to support the book in a second tilted position different from the first tilt position based on guiding the withdrawal of the book.

In some implementations, the tilt guide bar may be further configured to, based on guiding the withdrawal of the book, roll relative to the bottom surface of the sliding shelf.

According to another aspect, a bookshelf includes a book stand space that is configured to receive a book, and a tilt guide bar that is located at a bottom portion of the book stand space and that extends in a lateral direction. The tilt guide bar is configured to, based on the book being pressed downward, roll to allow the book to be tilted about the tilt guide bar and to guide a withdrawal of the book in a state in which an upper end portion of the book protrudes forward.

Implementations according to this aspect may include one or more of the following features or the features described above. For instance, the tilt guide bar may have a semicircular sectional shape or semi-elliptical sectional shape.

The effects are not limited to those mentioned above, and other effects can be clearly understood by those skilled in the art from the following description.

DETAILED DESCRIPTION

Figure 1:
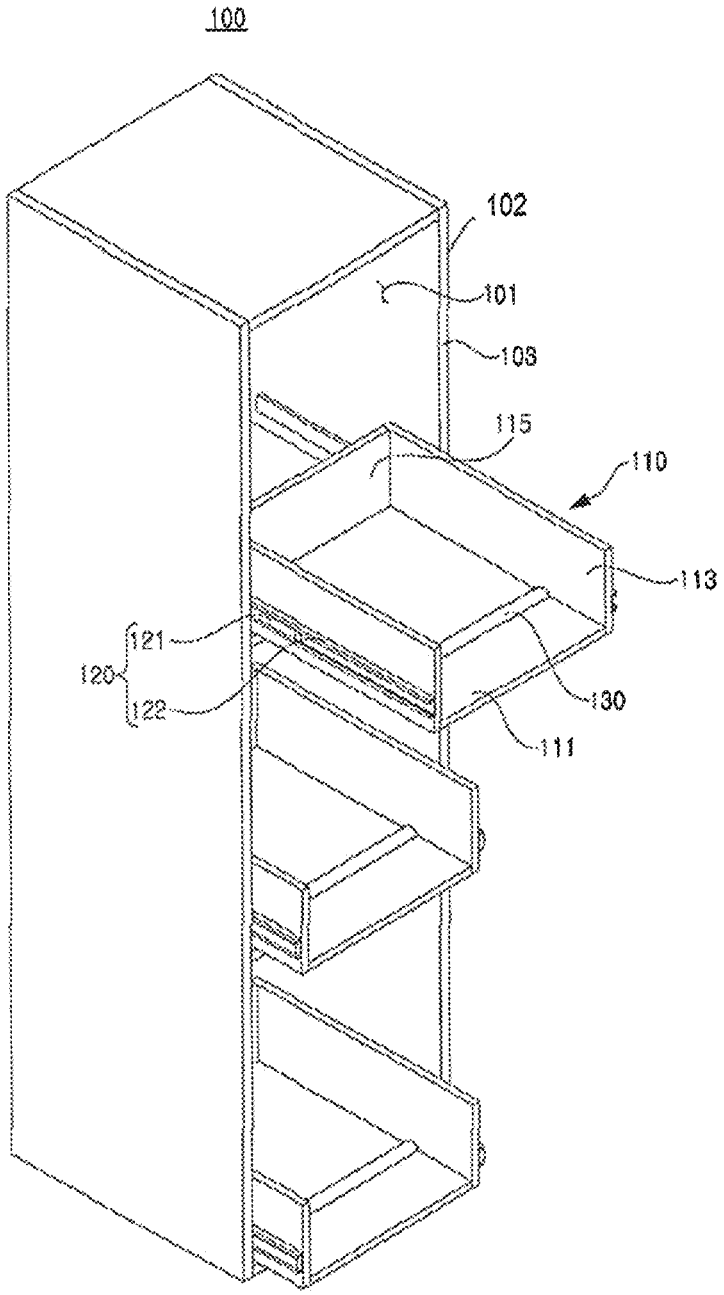
FIG. 1 is a perspective view showing an example bookshelf.

Hereinafter, implementations will be described in detail with reference to the accompanying drawings.

In the following description, detailed description of known functions and configurations incorporated herein will be omitted when it may make the subject matter rather unclear. In addition, the terms described below are defined in consideration of the functions, and these may vary depending on the intention of the user or judicial precedent. Therefore, the definition should be based on the contents throughout this specification.

In the description, the same or similar elements will be denoted by the same or similar reference numerals, and a detailed description thereof will be omitted.

Hereinafter, a bookshelf will be described in detail with reference to the accompanying drawings.

Figure 2:
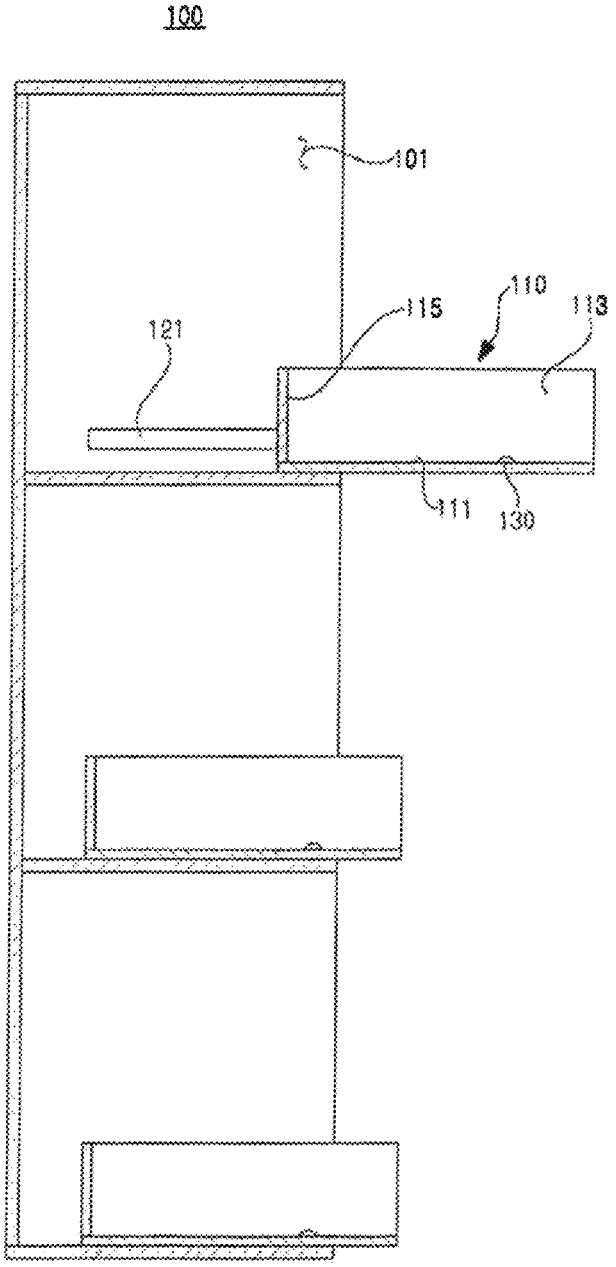
FIG. 2 is a sectional view of FIG. 1.
Figure 3:
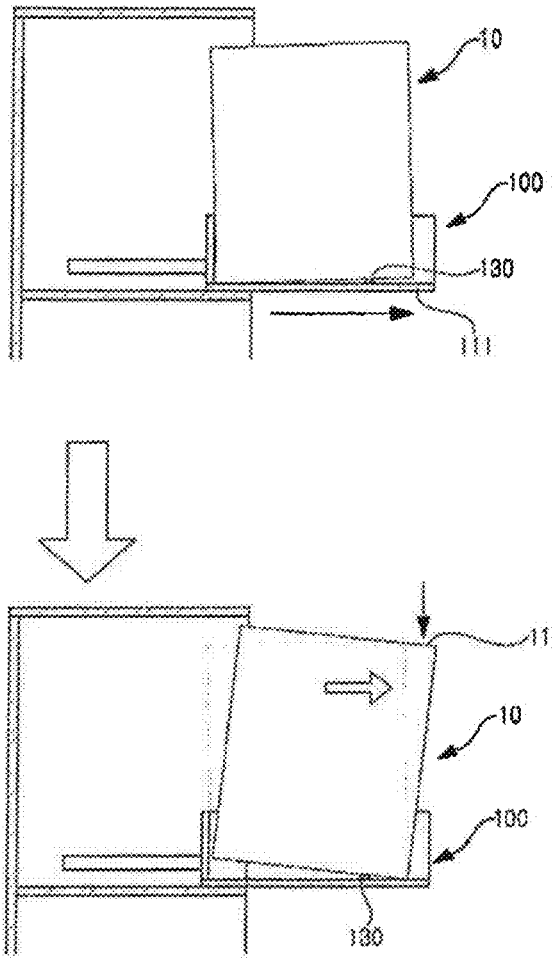
FIG. 3 is a sectional view showing an example state in which a book is withdrawn for the example bookshelf shown in FIG. 2.

FIG. 1 is a perspective view showing an example bookshelf, FIG. 2 is a sectional view of FIG. 1, and FIG. 3 is a sectional view corresponding to FIG. 2 and shows an example state in which a book is withdrawn.

Referring to FIGS. 1 to 3, a bookshelf 100 includes at least one book stand space 101, a sliding shelf 110, a rail portion 120, and a tilt guide bar 130. In some examples, a frame 102 may define the book stand space 101.

The sliding shelf 110 according to the present disclosure is installed in the book stand space 101 to serve as a book stand for receiving a book 10 and includes a bottom 111, left and right side walls 113, and a rear wall 115 and has a box structure in which a front surface and an upper surface are opened. The sliding shelf 110 may be formed of a transparent material, for example, an acrylic plate so that the book 10 accommodated therein can be easily recognized.

The rail portion 120 is installed on left and right side frame walls 103 of the book stand space 101, and left and right side walls 113 of the sliding shelf 110 to allow the sliding shelf 110 to move back and forth. The rail portion 120 may include a fixed rail 121 fixed to the left and right side frame walls 103 of the book stand space 101 and a sliding rail 122 fixed to the left and right side walls 113 of the sliding shelf 110 and movably coupled to the fixed rail 121.

The tilt guide bar 130 may have a semicircular section or a semi-elliptical section to serve as a lever and be attached to the sliding shelf 110. In some cases, the tilt guide bar 130 may have other shapes such as an angular shape to serve as a lever and be attached to the sliding shelf 110. The tilt guide bar 130 may protrude upward from a bottom surface of the sliding shelf 110. The tilt guide bar 130 may be disposed at a front portion on the basis of the longitudinal direction of the sliding shelf 110.

When a book is withdrawn from the sliding shelf 110, if the sliding shelf 110 in which the book 10 is accommodated is pulled out, the sliding shelf 110 is pulled out of the bookshelf 100 along the rail portion 120. Then, when a user pulls an upper end portion of the book to be withdrawn by using a finger, the upper end portion 11 protrudes forward while being tilted downward due to the tilt guide bar 130 arranged on the bottom 111 so that the user can easily withdraw the book.

When it is necessary to withdraw a book from a general bookshelf tightly filled with books, it is inconvenient to withdraw the book because left and right sides of the book are pressed by another books. However, when the tilt guide bar is provided as in the present disclosure, the book protrudes while being tilted due to the leverage effect so that the book can be easily withdrawn even with a small force.

Figure 4:
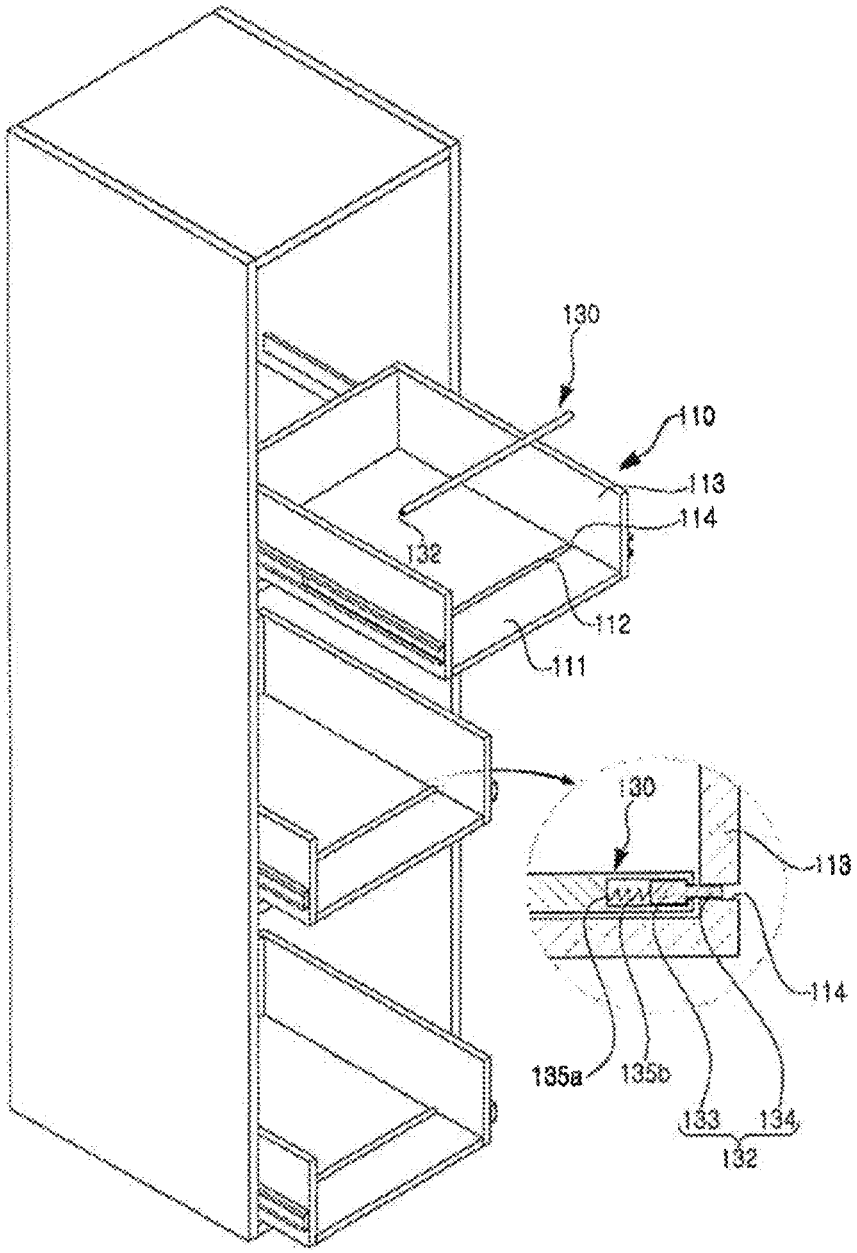
FIG. 4 is a perspective view showing another example bookshelf.
Figure 5:
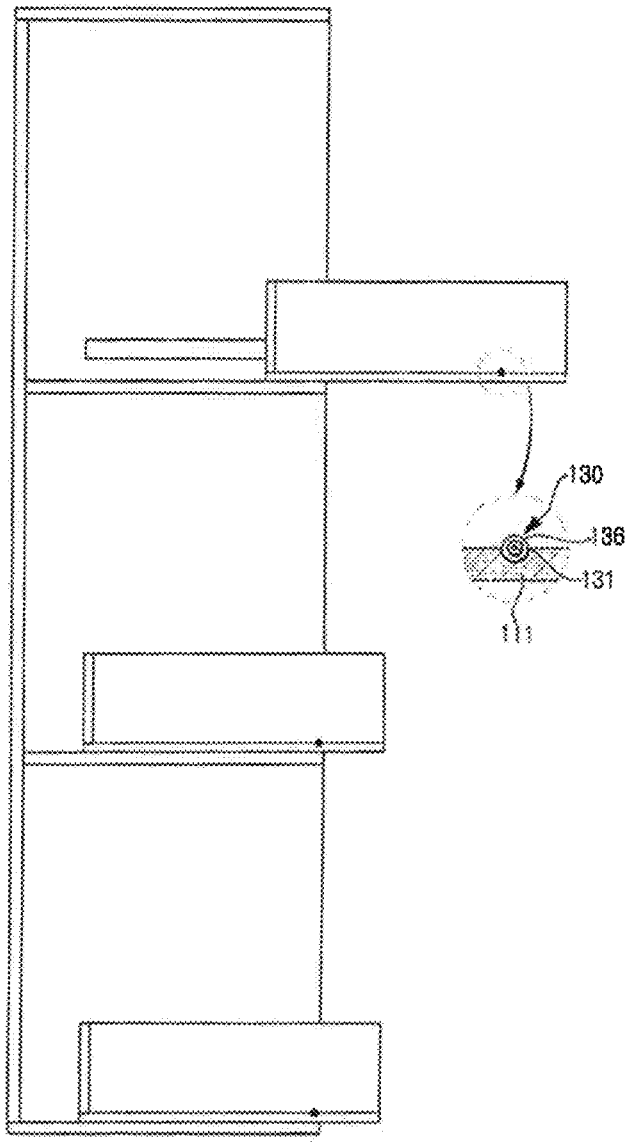
FIG. 5 is a sectional view of FIG. 4.

FIG. 4 is a perspective view showing another example of a bookshelf, and FIG. 5 is a sectional view of FIG. 4.

Referring to FIGS. 4 and 5, unlike the above-described implementation, the bookshelf 100 which is convenient to withdraw a book according to the present implementation has a structure in which the tilt guide bar 130 rotates.

In order to rotate the tilt guide bar 130 of the present implementation, a tilt guide bar receiving groove 112 having a semicircular section is formed in the bottom 111 of the sliding shelf 110 in the lateral direction, and a fixing hole 114 into which both ends of the tilt guide bar 130 are inserted is formed at lower ends of the left and right side walls 113 of the sliding shelf 110.

In some implementations, the tilt guide bar 130 may have a circular section, a lower portion of the tilt guide bar 130 is inserted into the tilt guide bar receiving groove 112, an upper portion of the tilt guide bar 130 protrudes from the bottom 111 of the sliding shelf 110, and the tilt guide bar 130 is configured to be rotatably coupled to the left and right side walls 113 of the sliding shelf 110.

In some implementations, the tilt guide bar 130 may include a fixed bar 131 fixed in the fixing hole 114, and a rotary tube 136 rotatably fitted to the fixed bar 131.

As described above, the tilt guide bar 130 may be configured to rotate so that the book can be withdrawn more easily.

According to the present implementation, when the book 10 to be withdrawn is pulled out, the rotary tube 136 may rotate. In some cases, other books around the book to be withdrawn may be moved forward due to the rotation of the rotary tube 136. In some cases, when a large number of books press the rotary tube 136, the rotary tube 136 may not smoothly rotate due to the load applied thereto.

Additional implementation examples will be described with reference to the accompanying drawings.

Figure 6:
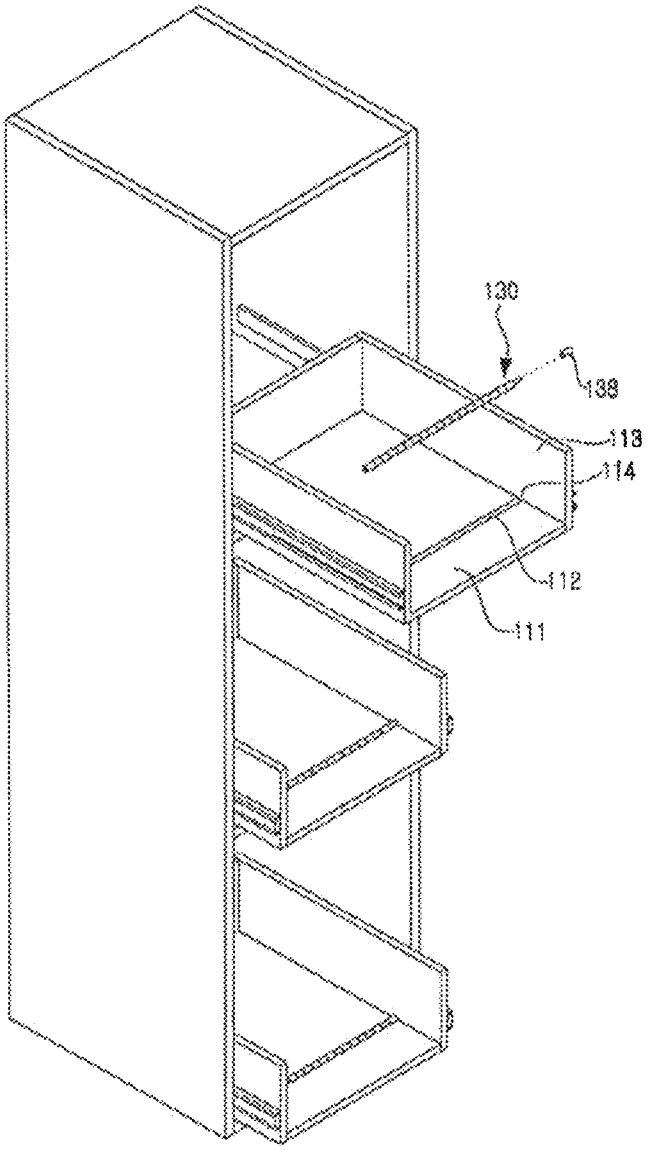
FIG. 6 is a perspective view showing another example bookshelf.
Figure 7:
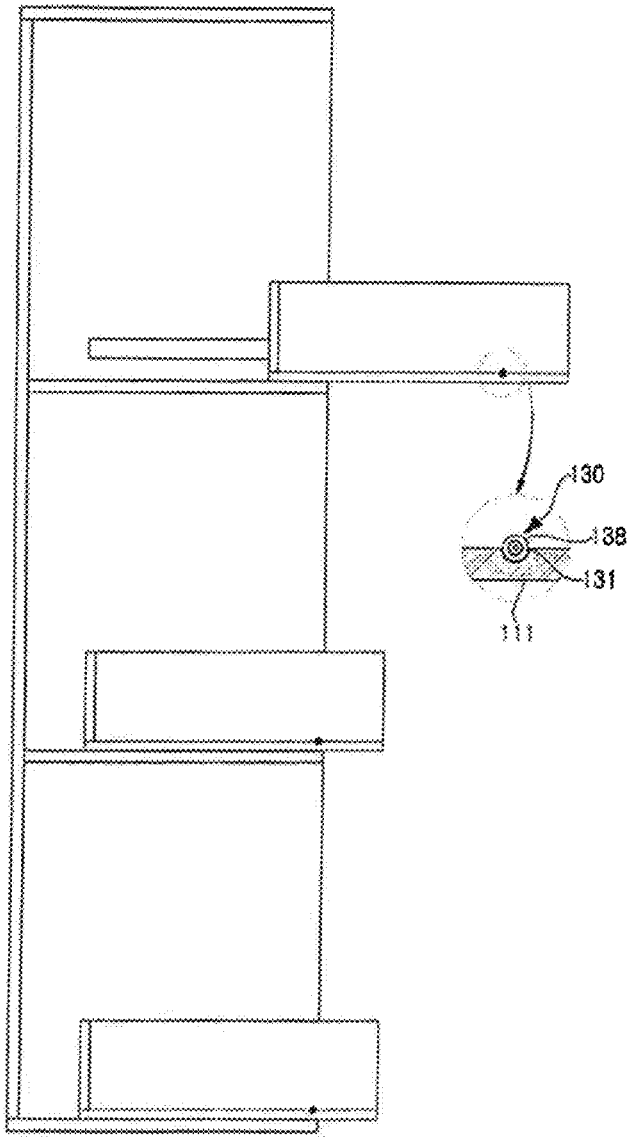
FIG. 7 is a sectional view of FIG. 6.

FIG. 6 is a perspective view showing still another implementation of a bookshelf, and FIG. 7 is a sectional view of FIG. 6.

Referring to FIGS. 6 and 7, unlike the tilt guide bar shown in FIGS. 4 and 5, the tilt guide bar 130, in some implementations, may include a fixed bar 131, which is provided at both sides thereof with a fitting protrusion 132 coupled into the fixing hole 114, and a plurality of rotary rings 138 fitted to the fixed bar 131.

In this case, it is advantageous that the books are placed on a plurality of rotary rings 138, respectively, so that the books can be withdrawn independently without being affected by the neighboring books as much as possible.

For example, if the average thickness of the book is 3 cm and the thickness of the rotary ring is 1 cm, three rotary rings may be placed for one book. Thus, when the book to be withdrawn is pulled out, the rotary rings arranged for the neighboring books may not rotate so that the neighboring books may not come out together.

In other words, the rotary ring may be configured to have the thickness smaller than the thickness of the book, so that the book can be withdrawn independently from the neighboring books.

In some implementations, the thickness of the rotary ring may be set in such a manner that at least two or three rotary rings may be arranged for one book.

However, since the thicknesses of the books are not uniform, but different from each other, a rotary ring having a thickness of 1 cm, which is suitable for a thin book, may be arranged on the left side of the fixed bar, a rotary ring having a thickness of 1.5 cm may be arranged on the center of the fixed bar, and a rotary ring having a thickness of 2 cm, which is suitable for a thick book, may be arranged on the right side of the fixed bar. That is, rotary rings having different thicknesses may be arranged in combination.

In some implementations, a surface of the rotary ring may be coated with silicone so that the book may come in close contact with the books without slipping.

In some implementations, the fixed bar 131 may be configured to have a detachable structure. The tilt guide bar 130 has a function of allowing a user to effectively withdraw a book when there are many books tightly packed in the bookshelf. Accordingly, if the fixed bar has the detachable structure, it is possible to separate and store the fixed bar when the books are roughly filled in the bookshelf.

The fixed bar 131 having the detachable structure is formed at both side ends thereof with a space portion 135*a* having a fitting protrusion withdraw hole 135 and a spring 135*b* is installed in the space portion 135*a*.

The fitting protrusion 132 may include a body portion 133 inserted into the space portion 135*a* and a protrusion portion 134 extending from the body portion 133 and protruding to the outside through the fitting protrusion withdraw hole 135.

When the protrusion portion 134 is pressed, the protrusion portion 134 is introduced into the fitting protrusion withdraw hole 135 due to the elasticity of the spring 135*b*. When the pressing applied to the protrusion portion 134 is released, the protrusion portion 134 is separated from the fitting protrusion withdraw hole 135. When separating the protrusion portion 134 from the fixing hole 114, the protrusion portion 134 is pressed by a tool such as a pin having a diameter smaller than that of the fixing hole 114 in the direction opposite to the insertion direction of the protrusion portion such that the protrusion portion 134 can be introduced into the fitting protrusion withdraw hole 135 and then the protrusion portion 134 is removed from the fixing hole 114.

Figure 8:
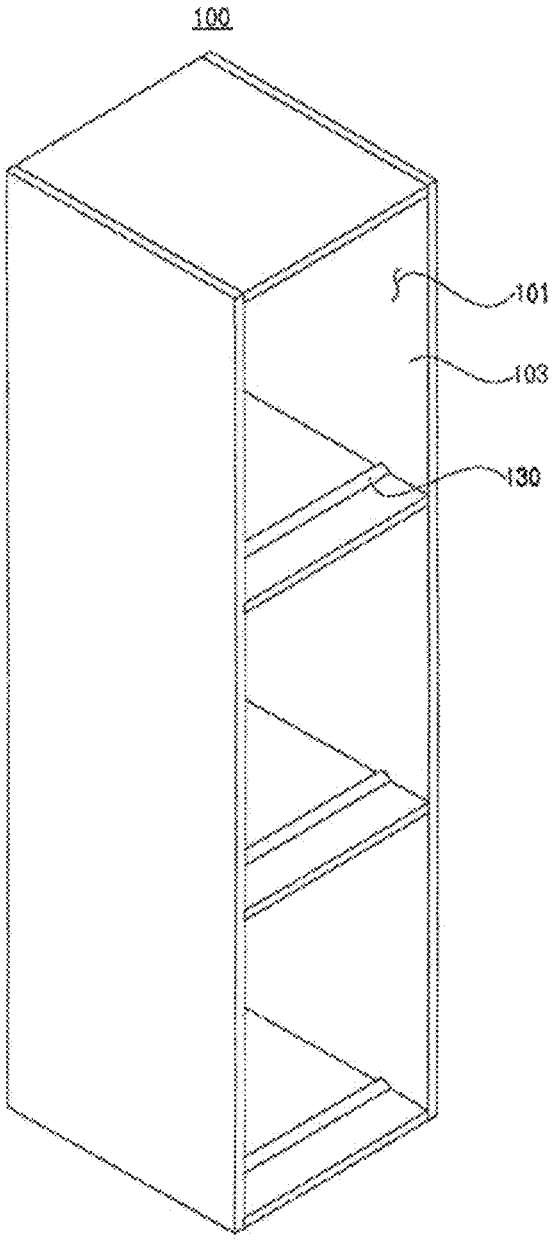
FIG. 8 is a perspective view showing another example bookshelf.

FIG. 8 is a view showing still yet another implementation of a bookshelf.

Referring to FIG. 8, the present implementation differs from the above-described implementations in that there is no sliding shelf and the tilt guide bar 130 is installed on the bottom of the book stand space 101.

The tilt guide bar 130 may have a semicircular sectional structure or a semi-elliptical sectional structure.

Figure 9:
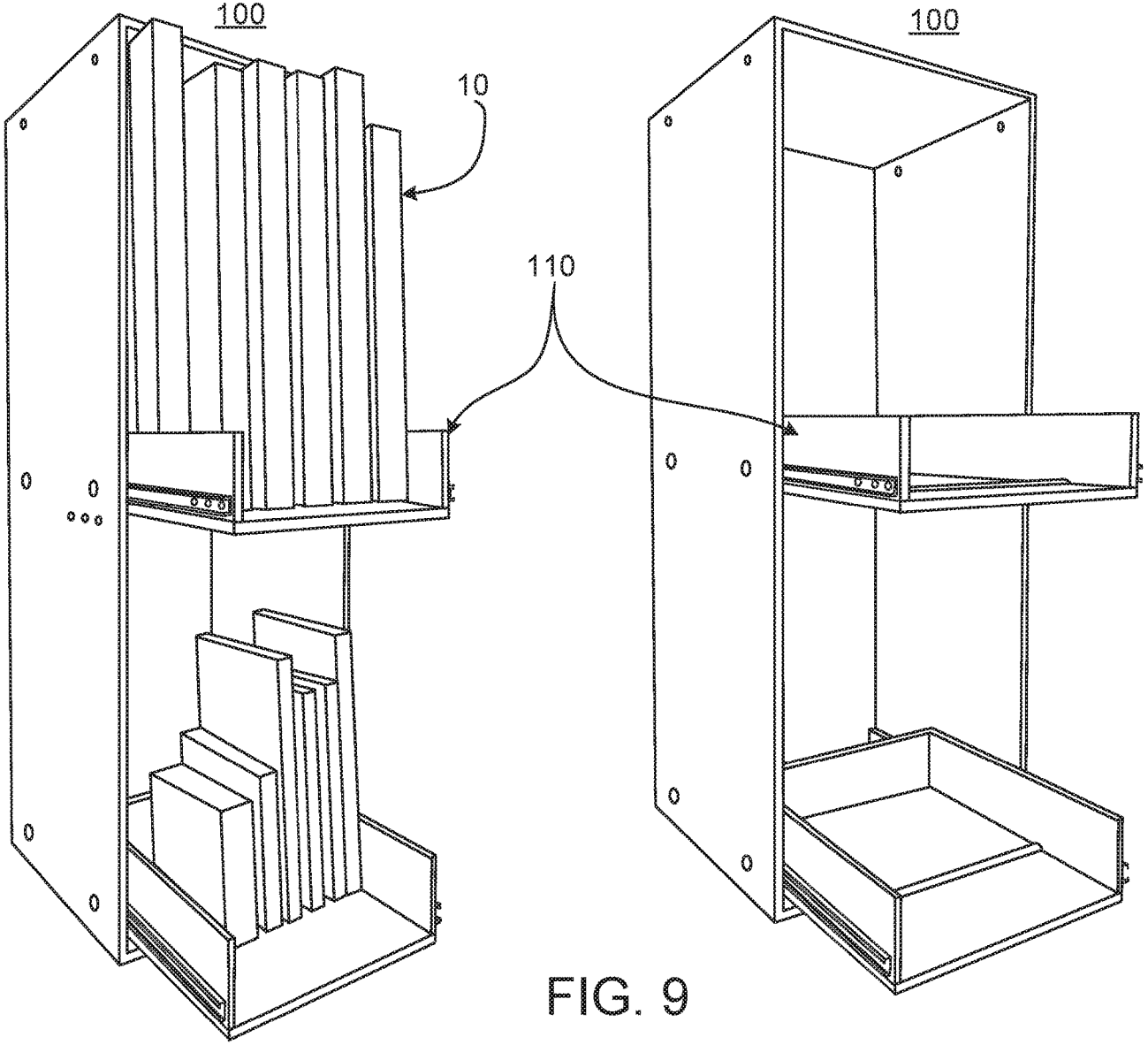
FIG. 9 is a view showing an example implementation of a bookshelf.
Figure 10:
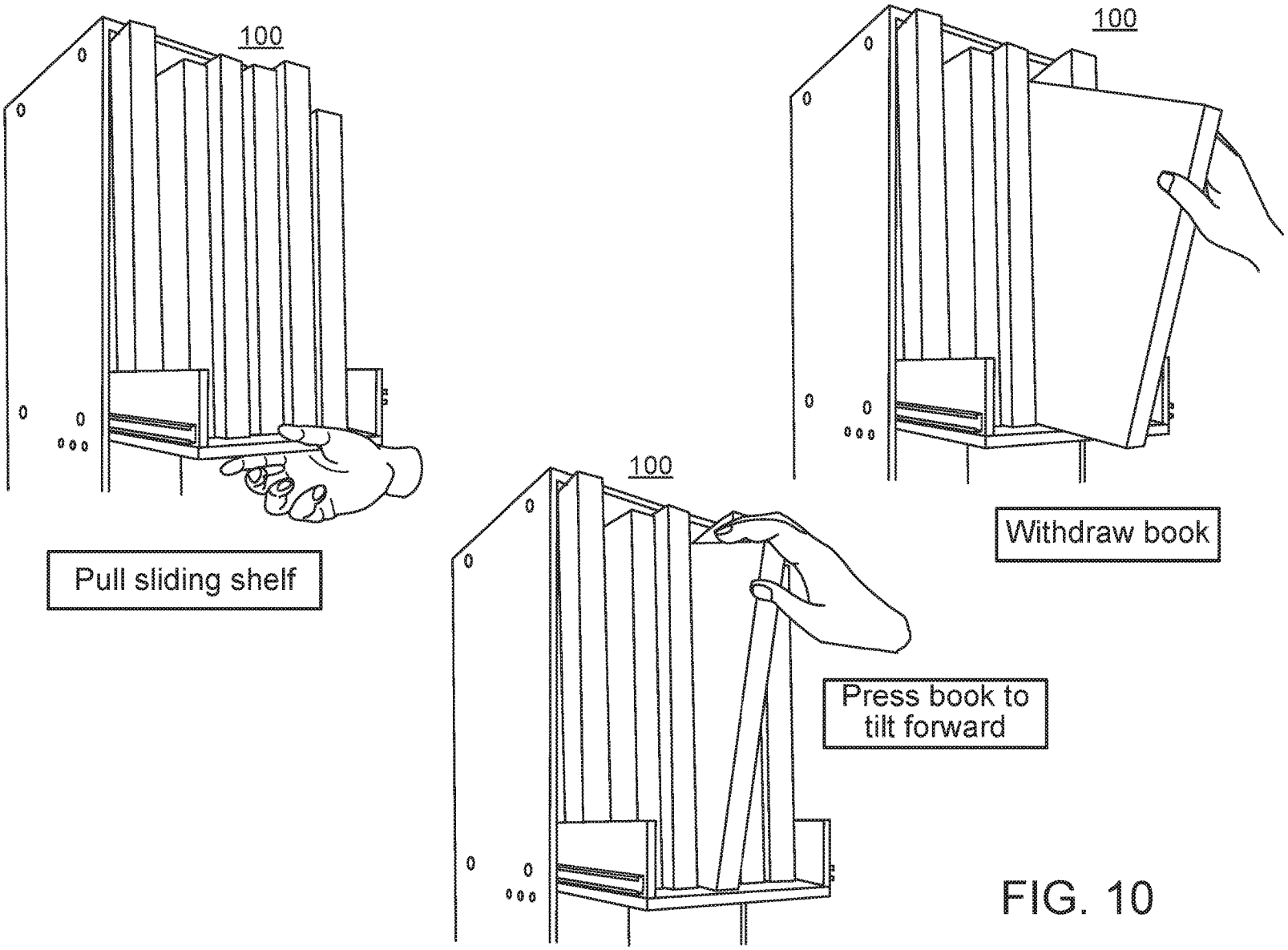
FIG. 10 is a view showing an example usage of the bookshelf shown in FIG. 9.

FIGS. 9 and 10 illustrate an example implementation of a bookshelf and an example usage of the bookshelf, respectively. For example, a user may pull the sliding shelf 110 (see FIG. 4) forward, press a book to be withdrawn (e.g., an upper end of the book) downward, and easily withdraw the book based on the upper end of the book protruding forward by rolling of the tilt guide bar 130 (see FIG. 4).

It can be understood that the present disclosure is not limited to the implementations described above. Accordingly, the true scope should be determined by the technical idea of the appended claims. It can be also understood that the present disclosure may cover all modifications, equivalents, and alternatives falling within the spirit and scope as defined by the appended claims.

What is claimed is:

1. A bookshelf comprising:

a frame that defines at least one book stand space configured to receive a book, the frame comprising a first frame wall and a second frame wall that faces the book stand space;

a sliding shelf disposed in the book stand space configured to insert into and withdraw from the book stand space;

a rail portion that is disposed at the first frame wall, the second frame wall, and the sliding shelf and that is configured to allow the sliding shelf to insert into and withdraw from the book stand space; and a tilt guide bar that is disposed at a bottom surface of the sliding shelf and that extends in a lateral direction toward the first frame wall and the second frame wall, wherein the tilt guide bar is configured to:

based on the book being pressed downward in a state in which the sliding shelf moves forward along the rail portion, allow the book to be tilted about the tilt guide bar and cause an upper end portion of the book to protrude forward, and guide a withdrawal of the book in a state in which the upper end portion of the book protrudes forward, wherein the sliding shelf comprises the bottom surface, a first side wall, a second side wall, and a rear wall, wherein the sliding shelf defines a front opening at a front surface of the sliding shelf and a top opening at a top surface of the sliding shelf, wherein the rail portion comprises:

a fixed rail coupled to the first frame wall and the second frame wall, and a sliding rail that is coupled to the first side wall and right side wall, and that is movably coupled to the fixed rail, and that configured to move relative to the fixed rail, wherein the sliding shelf defines:

a tilt guide bar receiving groove that has a semicircular sectional shape, that is recessed from the bottom surface of the sliding shelf, and that extends in the lateral direction, and a fixing hole that is disposed at a lower end of the first side wall and a lower end of the second side wall, each fixing hole being configured to receive an end of the tilt guide bar, wherein the tilt guide bar includes:

a lower portion inserted into the tilt guide bar receiving groove, and an upper portion that protrudes upward from the bottom surface of the sliding shelf, wherein the tilt guide bar is rotatably coupled to the first side wall and second side wall of the sliding shelf, wherein the tilt guide bar comprises:

a fixed bar disposed at both ends of the tilt guide bar, the fixed bar including a fitting protrusion coupled into one of the fixing holes, and a plurality of rotary rings that are each rotatably fitted to the fixed bar, and wherein the fixed bar defines:

a space portion at both side ends of the fixed bar, the space portion being configured to receive a portion of the fitting protrusion, and a fitting protrusion withdraw hole that is in communication with the space portion and that is configured to allow the fitting protrusion to withdraw from and protrude toward the sliding shelf.

2. The bookshelf of claim 1, wherein the tilt guide bar has a circular sectional shape.

3. The bookshelf of claim 1, wherein the fixed bar further comprises a spring disposed in the space portion, and wherein the fitting protrusion comprises:

a body portion disposed inside of the space portion; and a protrusion portion that extends from the body portion, that is configured to protrude outward through the fitting protrusion withdraw hole based on elasticity of the spring, and that is configured to move toward the fitting protrusion withdraw hole based on the protrusion portion being pressed in the lateral direction.

4. The bookshelf of claim 1, wherein the tilt guide bar is configured to contact and support a bottom surface of the book.

5. The bookshelf of claim 1, wherein the tilt guide bar is configured to:

support the book in a first tilt position based on receiving the book; and support the book in a second tilted position different from the first tilt position based on guiding the withdrawal of the book.

6. The bookshelf of claim 1, wherein the tilt guide bar is further configured to, based on guiding the withdrawal of the book, roll relative to the bottom surface of the sliding shelf.

* * * * *